US008162415B2

(12) United States Patent
Hägele et al.

(10) Patent No.: US 8,162,415 B2
(45) Date of Patent: Apr. 24, 2012

(54) MULTIPART HOUSEHOLD APPLIANCE

(75) Inventors: Fritz Hägele, Herbrechtingen (DE); Karl-Friedrich Laible, Langenau (DE); Hans-Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 730 days.

(21) Appl. No.: 12/226,362

(22) PCT Filed: Apr. 2, 2007

(86) PCT No.: PCT/EP2007/053190
§ 371 (c)(1),
(2), (4) Date: Oct. 16, 2008

(87) PCT Pub. No.: WO2007/122072
PCT Pub. Date: Nov. 1, 2007

(65) Prior Publication Data

US 2009/0151385 A1 Jun. 18, 2009

(30) Foreign Application Priority Data

Apr. 20, 2006 (DE) ..... 10 2006 018 426

(51) Int. Cl.
*A47B 87/00* (2006.01)

(52) U.S. Cl. ..... 312/198; 312/111

(58) Field of Classification Search ..... 312/107, 312/108, 111, 296, 401, 198–201; 62/298, 62/377
See application file for complete search history.

(56) References Cited

U.S. PATENT DOCUMENTS

| | | | | | |
|---|---|---|---|---|---|
| 1,321,097 | A | * | 11/1919 | Gonzalez | 217/45 |
| 2,429,294 | A | * | 10/1947 | Pollock | 62/442 |
| 2,444,887 | A | * | 7/1948 | Wyeth | 312/198 |
| 2,721,454 | A | * | 10/1955 | Levey | 62/335 |
| 2,945,733 | A | * | 7/1960 | Malia | 312/200 |
| 3,055,723 | A | * | 9/1962 | Hildebrand, Sr | 312/200 |
| 3,113,358 | A | * | 12/1963 | Zell et al. | 312/263 |
| 3,301,618 | A | * | 1/1967 | Feldser et al. | 312/111 |
| 3,310,905 | A | * | 3/1967 | Davis et al. | 43/57.1 |
| 3,350,755 | A | * | 11/1967 | Hanner | 24/460 |
| 3,905,662 | A | * | 9/1975 | Richmond | 312/249.8 |
| 4,017,131 | A | * | 4/1977 | Camenisch | 312/198 |
| 5,267,873 | A | * | 12/1993 | Provenzale | 439/347 |
| 5,447,366 | A | * | 9/1995 | Cole | 312/50 |
| 5,749,636 | A | * | 5/1998 | Boury | 312/201 |
| 5,921,095 | A | | 7/1999 | Lee et al. | |
| 7,004,436 | B2 | * | 2/2006 | Knapp | 248/220.22 |
| 2009/0077996 | A1 | * | 3/2009 | Gorz et al. | 62/441 |

FOREIGN PATENT DOCUMENTS

EP 0441363 * 8/1991

(Continued)

OTHER PUBLICATIONS

International Search Report PCT/EP2007/053190.

*Primary Examiner* — James O Hansen
*Assistant Examiner* — Sasha T Varghese
(74) *Attorney, Agent, or Firm* — James E. Howard; Andre Pallapies

(57) ABSTRACT

A household appliance is provided that includes a first and a second housing which are disposed next to each other such that one sidewall faces another sidewall and which are attached to one another. A seal is elastically compressed between facing outer surfaces of the sidewalls. At least one shoulder that is rigidly connected to the outer surface is provided on each housing. The shoulders of the two housings face away from each other while being flush with one another in a direction that extends essentially perpendicular to the outer surfaces.

25 Claims, 4 Drawing Sheets

FOREIGN PATENT DOCUMENTS

| | | | |
|---|---|---|---|
| FR | 2.106.309 | | 4/1972 |
| FR | 2433718 | A2 | 3/1980 |
| JP | 5-164457 | | 6/1993 |
| JP | 5-164458 | | 6/1993 |
| JP | 9-222278 | | 8/1997 |
| JP | 2002-130923 | | 5/2002 |
| WO | WO 2004/001305 | | 12/2003 |
| WO | WO 2006/013182 | | 2/2006 |

* cited by examiner

MULTIPART HOUSEHOLD APPLIANCE

BACKGROUND OF THE INVENTION

The present invention relates to a household appliance having a first and a second housing, which are arranged next to each other and fixed to each other sidewall to sidewall (side-by-side arrangement).

DE 202 09 516 U1 disclosed a refrigerator and freezer device of this type which consists of a block-shaped refrigerator part and a freezer part that can be set up side by side to make a unit. The intermediate space is closed off in an airtight manner by means of a seal. This prevents moisture-laden air penetrating into the gap zone between the refrigerator part and the freezer part—which gap zone is cooler in comparison with the environment—and condensing on the side surfaces of the refrigerator part and the freezer part. Fixing bars are attached on the front side to prevent the appliances moving apart.

With this mode of construction, however, it can happen, due to careless shifting during or after the assembly of the household appliances, that the gap between the mutually facing wall surfaces becomes wider toward the rear side of the refrigeration appliance and thus the peripheral seal becomes ineffective. Moreover, it has also been found that the sensitive seals can be damaged during the shifting of the housings into the "target position" in difficult assembly situations.

A further disadvantage of this known device is that it is difficult to compress the seal with a high level of force in order to ensure a reliable sealing effect, and that there is a danger of the two housings being pushed apart over the course of time by the force of the seal compressed between them until finally the sealing effect is no longer ensured.

BRIEF SUMMARY OF THE INVENTION

The object of the present invention is to specify a household appliance having a first and a second housing and a seal compressed elastically between mutually facing outer surfaces of the sidewalls of the housings wherein one or other of the above disadvantages is eliminated or at least alleviated.

The object is achieved in that at least one shoulder that is rigidly joined to the outer surface is provided on each housing, and in that the shoulders of the two housings are positioned facing away from each other and lie flush with each other in a direction that is essentially perpendicular with respect to the outer surfaces. A tool such as a pair of tongs or a screw clamp can be applied on the shoulders, with the aid of which tool the walls can be pressed against each other with a high level of force, in order thus to obtain a reliable sealing effect.

In order to safeguard the sealing effect over the long term, a tool of the screw clamp type could be left mounted on the shoulders. Preferably, however, one channel that is essentially parallel to the outer side of the relevant sidewall is formed in each case on the mutually facing sidewalls, so that if the housings are held together by a locking bar inserted into the channels of the two sidewalls, the sealing effect is ensured in a lasting manner even after removal of the tool.

In accordance with a preferred embodiment, the channels are delimited by bands separated from each other by slits in each case, the bands of the one channel engaging in the slits of the other channel. The bands thus form a compartment into which the locking bar can be introduced in the nature of a weft thread.

In accordance with a preferred development, a hinge connecting the housings in a swiveling manner is attached to a border of the mutually facing sidewalls of the housings in each case, and a connecting element is attached to the housings and spaced away from this border, which element blocks the freedom of movement of the hinge. The hinge simplifies the assembly of the housings at their installation location since they can first be connected with the hinge without the seal having to be compressed for that purpose. The compression of the seal is then only effected in a swiveling movement of the housings toward each other about the axis defined by the hinge, in this case the shoulders, in order to obtain a good leverage effect, preferably being arranged on an edge of the mutually facing sidewalls that faces away from the hinge. A compression of the seal brought about by means of the hinge has the advantage, moreover, that a slipping of the housings toward each other, which could otherwise result in the damaging of the seal, is ruled out.

The above-mentioned channels and the locking bar can then be part of the connecting element; but they can also comprise parts of the hinge.

To enable good accessibility of the hinges and therefore a simple assembly of the hinges on site and at the same time to avoid unsightly elements in the zone of the housings visible to the customer after assembly, the hinge is attached to the rear border of the mutually facing sidewalls.

It is particularly advantageous in this respect that a cavity is formed at one corner of each housing at which the mutually facing sidewalls and a rear wall of each housing meet each other, and that the axis of the hinge runs in the cavity. This embodiment variant prevents the hinge extending beyond the rear wall of the housings and forming a projection that would be disruptive during the installation of the household appliance on a wall or during fitting into a frame provided for the purpose.

Preferably, the hinge comprises one part fixed to the first housing and one to the second in each case, the parts intermeshing in a form-fitting manner in the direction of the swiveling axis of the hinge, in order to also enable a transmission of forces that are parallel to the swiveling axis between the housings.

To obtain a stable suspension of the hinges on the housings, the hinge comprises in a preferred embodiment a part fixed to the first or second housing in each case, the parts being fixed so as to extend beyond a corner of the first or second housing in each case.

In order that the hinge parts can be produced in large quantity and therefore cost-effectively, the hinge comprises a part fixed to the first or second housing in each case, which are identical in form. The hinge parts are formed in such a way that they intermesh and that a form fit exists between the parts in the direction of the swiveling axis of the hinge in order to enable a transmission of vertical forces from one housing to the other. The assembly effort is moreover reduced if only a few assembly parts that differ in constructional form are needed for the construction of the household appliance.

A similar function to the locking bar of the connecting element can be performed by a removable rotating pin on the hinge: once the housings are brought together in such a way that the hinge parts intermesh, the rotating pin is simply pushed into the hinge parts as a swiveling axis.

In order to make it simple to apply the tool, the spacing between the two shoulders should be small, in particular smaller than the aggregate wall thickness of the sidewalls.

The shoulders are preferably in each case formed on an ancillary part that is mounted on a carcass of the first or second housing. This makes it possible to employ existing production processes for manufacturing each carcass and thus to keep the investment costs for the utilization of the invention low.

The ancillary part is preferably mounted on an upper side of the carcass.

In particular, the ancillary part can be an angle part, a first limb of which is fixed to one of the housings and a second limb protrudes from the housing in order to form the shoulder. If an ancillary part of this type is mounted on the upper side of the carcass, it is preferably removable in order not to hinder, after it has been used, the installing of the fully assembled household appliance in a recess.

In accordance with an alternative embodiment, the ancillary part is plate-shaped and is mounted so as to project over an edge of the carcass, the shoulder being formed by an edge of the projecting zone of the ancillary part. In particular, this edge can be part of an aperture that is formed in the projecting zone.

An ancillary part of this type can simultaneously bear a fixing strap for fixing to a furniture recess in which the household appliance is to be installed.

In order to accommodate tolerances between the dimensions of the household appliance and those of the recess and simultaneously keep the costs low, the fixing strap is preferably connected to the ancillary part in a single piece via at least one flexible weak point.

BRIEF DESCRIPTION OF THE DRAWINGS

Further features and advantages of the invention will emerge from the description of exemplary embodiments with reference to the attached figures, in which.

DETAILED DESCRIPTION OF THE PRESENT INVENTION

Figure 1:
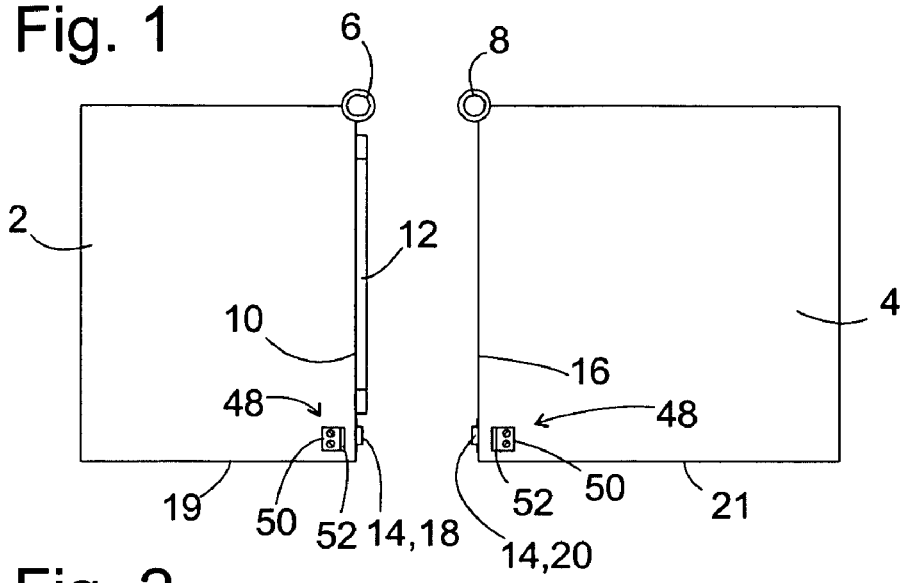
FIG. 1 shows a plan view of the inventive household appliance having a first and second housing prior to the start of assembly.

FIG. 1 is a plan view of two housings 2, 4 of an inventive household appliance prior to assembly. The housing 2 can be that of a refrigerator, for example, while the housing 4 belongs to a freezer. Hinge parts 6 and 8 are arranged in a rear corner zone of the housings 2 and 4 in each case. A rectangular frame made of a flexible sealing strip 12 is stuck on to a sidewall 10 of the housing 2 facing the housing 4, which is provided in order to be compressed between the sidewall 10 and the opposing sidewall 16 of the housing 4 in the assembled state. A connecting element comprises two brackets 18, 20 which are attached to the sidewalls 10, 16 in the vicinity of the front sides 19 and 21 of the housings 2, 4 in each case.

Angle parts 48 are fixed to the top sides of the housings 2, 4 adjacent to the front sides 19 and 21 and the sidewalls 10, 16 in each case. The angle parts 48 have a limb 50 screwed flat to the top side of the housing 2 or 4 and limbs 52 protruding vertically upward from the housings in each case.

Figure 2:
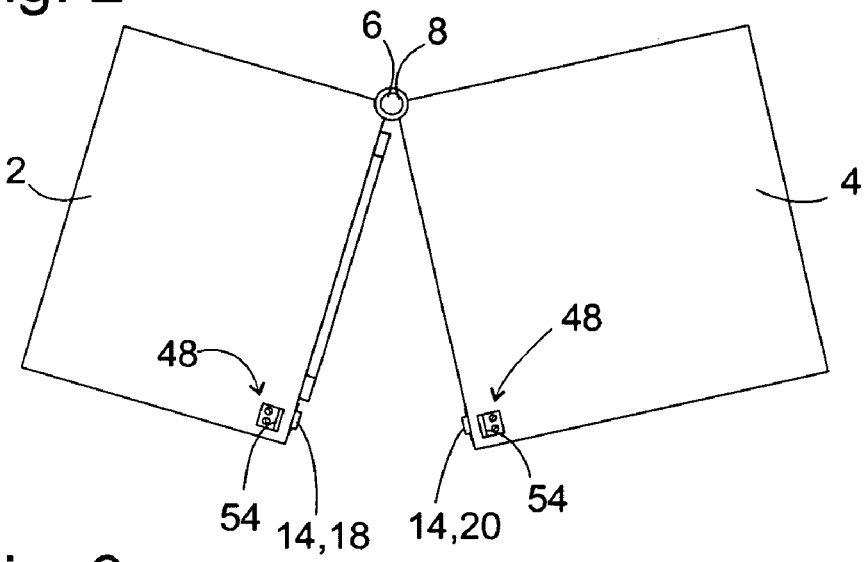
FIG. 2 shows a plan view of the inventive household appliance during assembly.
Figure 3:
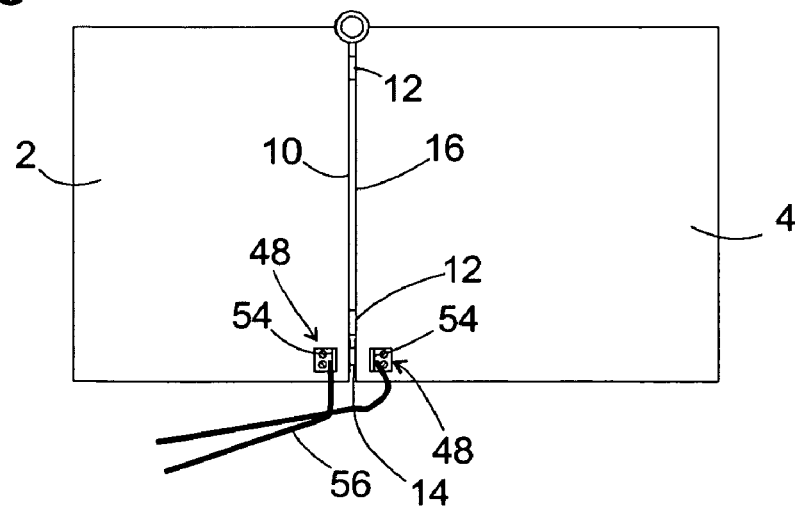
FIG. 3 shows a plan view of the inventive household appliance toward the end of assembly, immediately prior to insertion into a recess.
Figure 4:
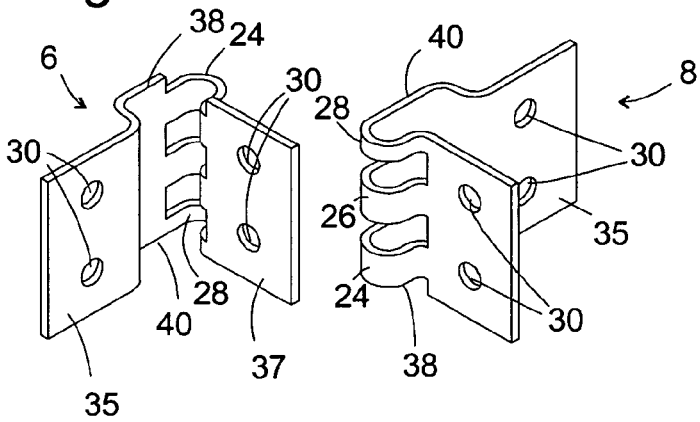
FIG. 4 shows a perspective representation of the hinge parts of the inventive household appliance.

In FIG. 1, the housings 2 and 4 are standing next to each other in the unconnected state. In a first assembly step, as shown in FIG. 2, the rear corners of the housings 2, 4 bearing the hinge parts 6, 8 are initially placed with respect to each other in such a way that the hinge parts 6, 8 intermesh and can be connected in a manner explained in more detail later. The connected hinge parts then define a swiveling axis about which the sidewalls 10, 16 of the housings 2, 4 are swiveled toward each other and in the process compress the sealing strip 12. FIG. 3 shows the housings 2, 4 in a state as swiveled toward each other in which the sidewalls 10, 16 are almost parallel. To be able to compress the sealing strip 12 further in this state and to bring the housings 2, 4 into a precisely parallel alignment, a pair of tongs 56 is applied to shoulders 54, which face away from each other and lie flush with each other in the width direction of the appliance, of the two angle parts 48 mounted opposite each other on the top sides of the housings 2, 4, which makes it possible to press the sidewalls 10, 16 against each other with a high level of force so that the seal 12 is compressed uniformly over its entire length and it becomes possible to latch the brackets 18, 20 of the connecting element 14 to each other.

After the latching element 14 has been latched, the angle pieces 48 that are then no longer needed are removed so that the fully assembled household appliance can be inserted unhindered into a recess or under a suspended cabinet.

For a better understanding of the construction and the assembly of the housings 2, 4, the construction of the hinge parts 6 and 8 attached to the rear border of the mutually facing sidewalls 10 and 16, and also of the connecting element 14 are explained with reference to FIGS. 5 to 8.

The hinge parts 6 and 8 are formed identically in a single piece out of sheet metal. They have two fixing wings 35 and 37 in each case, each with two screw holes 30 and a middle section 22 connecting the fixing wings in a bow shape, in which three brackets 24, 26, and 28 are separated from each other by horizontal slits. The fixing wings 35 and 37 of a hinge part 6 or 8 stand at right-angles to each other in order to be able to fix one to a sidewall and the other to a rear wall of the housing 2 or 4 in each case. Compared with the hinge part 8, the hinge part 6 is rotated and positioned in such a way that a side edge designated by 38, which is aligned upward in the case of the hinge part 6, points downward in the case of the hinge part 8, and vice versa a side edge 40.

Figure 5:
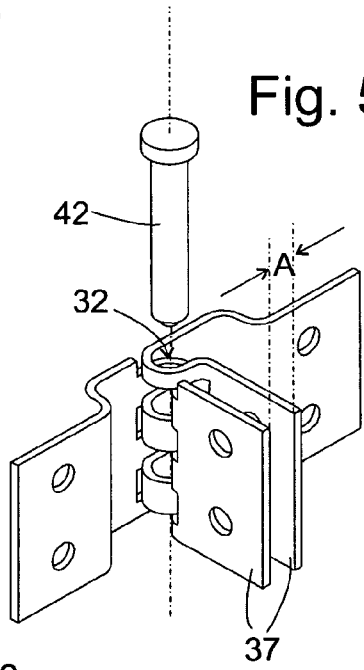
FIG. 5 shows a perspective representation of the hinge parts intermeshing in a form-fitting manner with the rotating pin at the point of the introduction of the rotating pin into the hinge.

In the perspective representation in FIG. 5, the brackets 24, 26, and 28 of the hinge parts 6 and 8 intermesh in a form-fitting manner and thus delimit a cylindrical void 32. This is intended for receiving a rotating pin 42 which holds the hinge parts 6, 8 together in a swiveling manner. The hinge parts 6 and 8 are formed in such a way that the fixing wings 37, which are intended for fixing the hinge parts 6 and 8 to the mutually facing sidewalls 10, 16 of the housings 2, 4, have a spacing A with respect to each other when the hinge straps 6 and 8 intermesh that is a little smaller than the thickness of the sealing strip 12.

Figure 6:
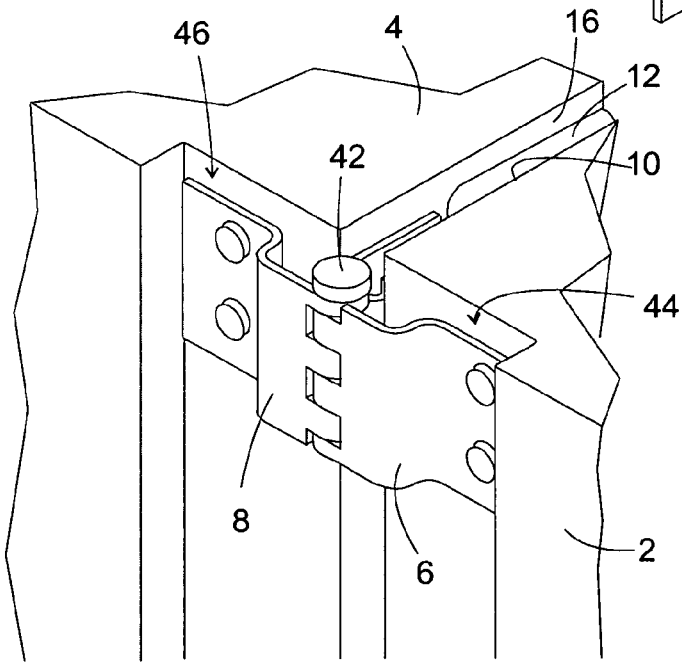
FIG. 6 shows a perspective representation of the rear side of the fully assembled inventive household appliance.

FIG. 6 shows the fully assembled housings 2 and 4 from the rear side. The hinge parts 6 and 8 are attached in a cavity 44, 46 between the side and rear wall of the housings 2, 4 in each case so that they do not extend beyond the rear wall of the housings. The rotating pin 42 and hinge parts 6 and 8 are joined together to make the finished hinge. The seal 12 lies pressed together on the respective sidewalls of the housings 10 and 16. By this means, the intermediate space surrounded by the seal 12 is closed off in an airtight manner.

As already mentioned with reference to FIG. 1, a connecting element 14 with two brackets 18, 20 is attached in the front zone of the sidewalls 10, 16 of the housings 2 and 4, which is now explained in more detail with reference to FIGS. 7 and 8.

Figure 7:
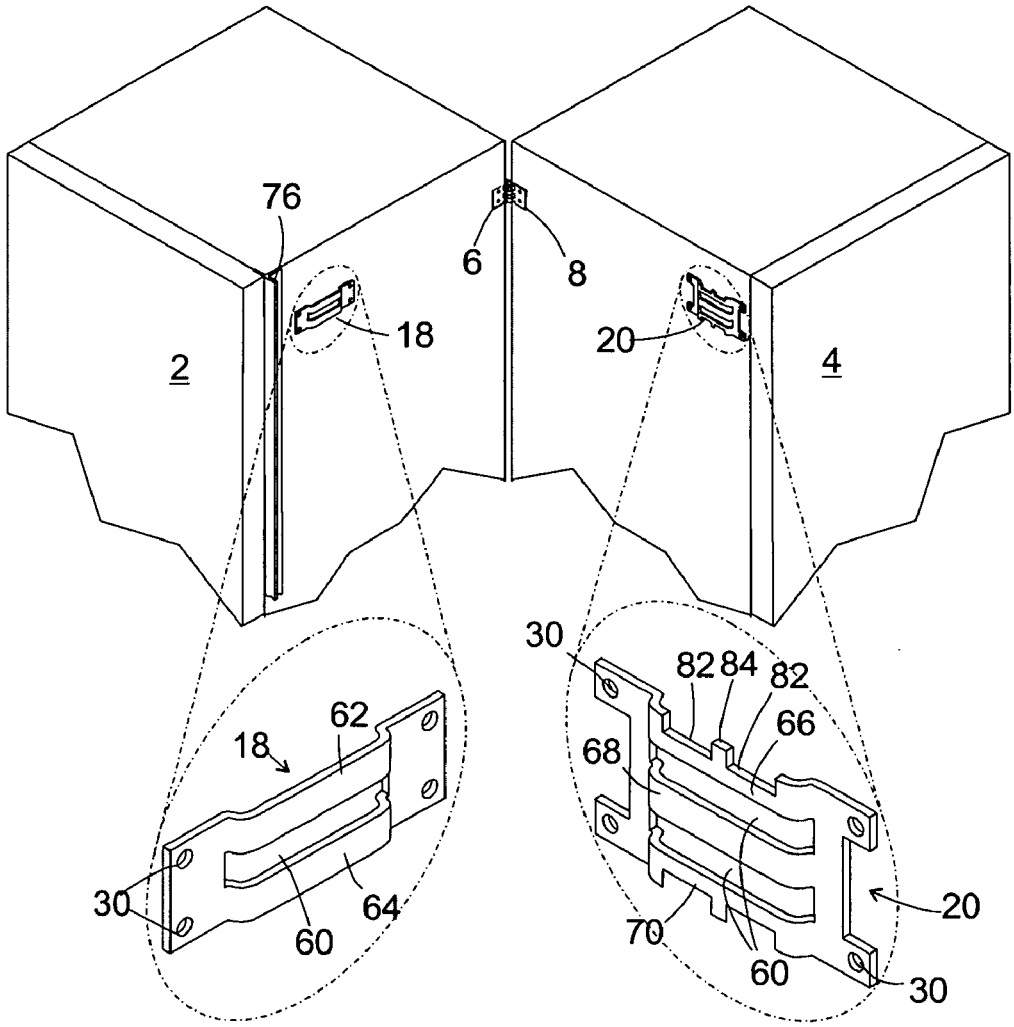
FIG. 7 shows a perspective representation of a detail of the household appliance with the connecting element during assembly.

FIG. 7 shows, in a perspective representation, the two housings 2, 4 in the state according to FIG. 2, as connected to each other via the hinge, in which the sidewalls 10, 16 do not yet lie tight opposite each other.

The brackets 18, 20 formed of sheet metal have two fixing flanges with drilled holes 30 in each case, which are used for screwing to the sidewalls 10, 16, and which are connected by means of two forward-bulging ribs 62 and 64 in the case of the bracket 18 or three ribs 66, 68, and 70 in the case of the bracket 20. The width of cavities 60 between the ribs of a bracket 18 or 20 is selected in such a way that the ribs of the other bracket in each case engage in them if the walls 10 16 are located in the position in FIG. 3.

The brackets 18, 20 are placed on the walls 10, 16 in such a way that together with the wall 10 or 16 they delimit a channel and that the ribs 62, 64 lie at the same height as the intermediate spaces between the ribs 66, 68, 70 and engage through these intermediate spaces in the channel of the other bracket in each case if the walls 10, 16 are swiveled toward each other and the sealing strip 12 is compressed between the walls 10, 16 by the pressing together of the angle parts 48. As shown in FIG. 8, a latching channel 72 is created by the intermeshing of the ribs 62, 64, 66, 68, 70 between themselves, into which a locking bar 74 is inserted in order to prevent the housings 2, 4 moving apart again and to keep the sealing strip 12 permanently under pressure.

Figure 8:
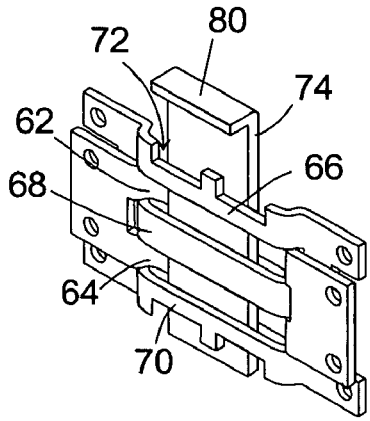
FIG. 8 shows a perspective representation of the connecting element with locking bar engaged.

It can be seen in FIG. 8 that the locking bar 74 has an angled end section 80 that comes to rest against a projection 84 directed upward between cavities 82 on the top border of the rib 66 and thus safeguards the engaged locking bar 74 against sliding through the latching channel 72. This ensures that, in the case of a rearrangement of the housings, it is possible to reach into one of the cavities 82 with a screwdriver or similar tool in order to get hold of the end section 80 and draw the locking bar 74 out of the latching channel 72 and thus release the latch.

Alternatively, the end section could be provided with a threaded hole that ends at the top edge of the rib 66. If a screw is screwed into this threaded hole and meets the top edge of the rib 66, it presses the end section 80 upward and thus gradually draws the locking bar 72 out of the latching channel 74. By this means it is even possible to release the locking bar if it is firmly lodged in the channel 72.

A flexible T-section 76 made of plastic shown in FIG. 7 is only inserted into the intermediate space between the walls 10, 16 after the brackets 18, 20 have been latched, in order to conceal the connecting element 14 and the seal 12.

Figure 9:
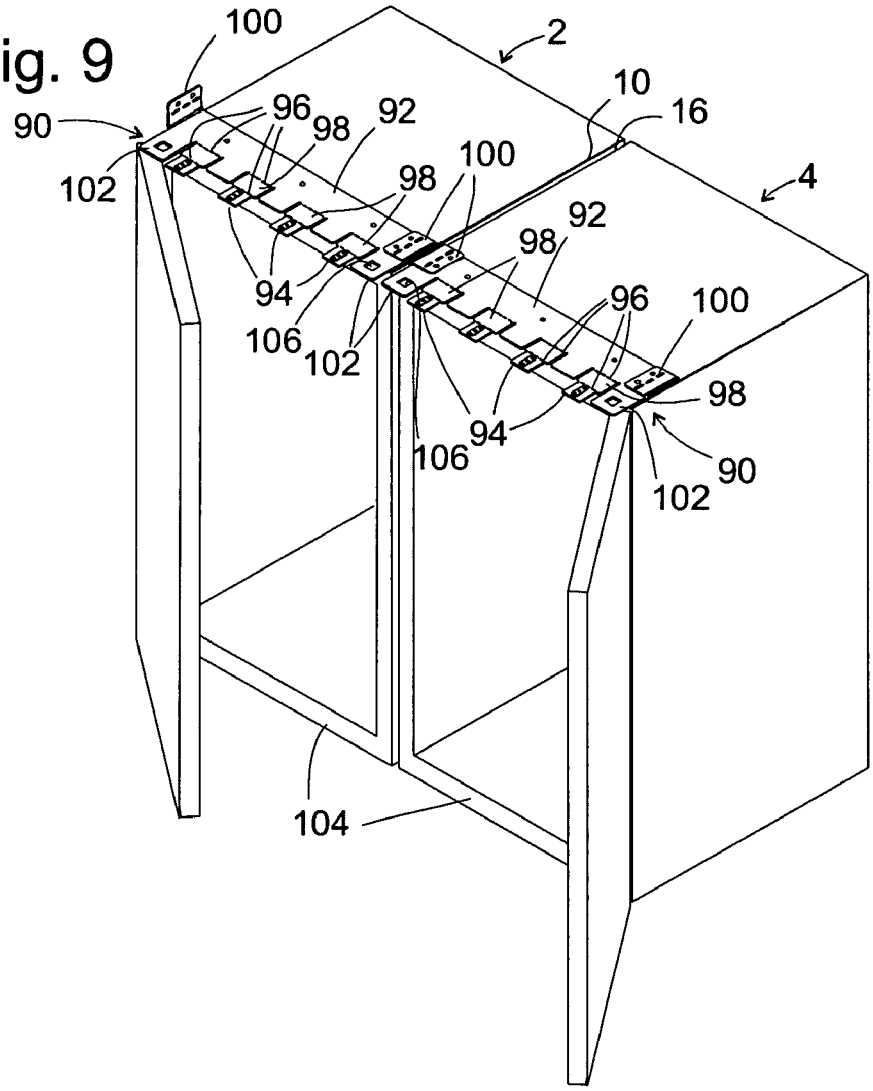
FIG. 9 shows a perspective view of the household appliance according to a second embodiment in the assembled state and prior to insertion into a recess.

FIG. 9 shows a perspective view of an inventive household appliance with housings 2, 4 according to a second embodiment. Each housing has a carcass and a door pivoting on a front side 104 of the carcass. Between the mutually facing walls 10, 16 of the two housings, a sealing strip 12 is held compressed by hinges and a connecting element as described above. A coupling plate 90 stamped out of sheet metal is screwed to the top front edge of each carcass. The coupling plate 90 comprises an essentially rectangular base plate 92, the width of which corresponds to that of the housing 2 or 4. Fixing straps 94 project over a front edge of the base plate 92 at uniform spacings from each other. Slits are cut in the base plate 92 on both sides of each fixing strap 94. Along the front edge of the base plate 92 and also between the ends of two adjacent slits in each case, groups 96 of oblong holes are punched out. The slits and the oblong holes 96 delimit spacing pieces 98 in each case, which are slightly flexible along the groups 96 and also with reference to the fixing straps 94 and also to the rest of the base plate 92.

Further fixing straps 100 are formed on the longitudinal ends of the base plate 92 and likewise set apart from the said base plate by groups of oblong holes. In the as-delivered state, the straps 100 are bent back onto the upper side of the base plate 92 as shown on the coupling plate 90 of the housing 4. On the housing 2, the left fixing strap 100 of the coupling plate 90 is folded up in order to enable it to be screwed to a wall (not shown) that is adjacent to the housing 2. The fixing strap could also be swiveled out by 180° in order to screw it to a neighboring appliance or item of furniture of the same height.

The base plate 92 has, on its front corners, two continuations 102 that in each case project over the front side 104 of the carcass and are provided with an aperture 106. If a pair of tongs is introduced into the apertures 106 of the mutually neighboring continuations 102 of the housings 2, 4 and presses against the borders of the apertures 106 (which here represent shoulders, facing away from each other, of the coupling plates 90), the two housings 2, 4 can be pressed against each other with a high level of force here also so that the sealing strip enclosed between their walls 10, 16 is compressed and the latching element can be latched as described above. In this latched state the household appliance according to this embodiment can be inserted into a recess immediately without the angle parts 48 provided according to the first embodiment having to be removed beforehand.

Figure 10:
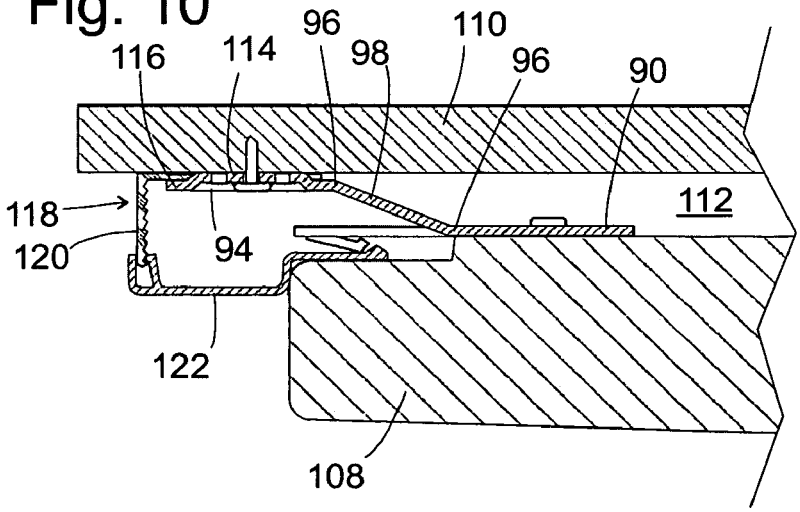
FIG. 10 shows a detail of the household appliance of FIG. 9 in the state as mounted in a recess in cross-section.

FIG. 10 shows a partial section through the ceiling 108 of the carcass of one of the housings 2, 4 and a ceiling 110 of a recess in which the housings 2, 4 are placed. The fixing straps 94 are screwed to the ceiling 110. In this respect, the spacing pieces 98 enable an adaptation to different widths of a gap 112 between the ceiling 108 of the housing 2 or 4 and the ceiling 110 of the recess by bending the bands connecting them to the base plate 90 or the fixing straps 94 between the oblong holes 96 so that the spacing pieces 98 take up a position of varying steepness depending on the width of the gap.

The fixing straps 94 are contoured so that a central zone 114 of them lies against the ceiling 110, while a gap remains between a border zone 116 of them and the ceiling 110, into which a first covering strip 118 can be inserted from the front, which conceals the gap 112 toward the front. A second covering strip 122 is latched at a grooved rear side of a vertical limb 120 of the first covering strip 118 and in a slot between the base plate 92 and the ceiling 108.

The invention claimed is:

1. A household appliance comprising:

a first housing with a sidewall having an outer surface and a shoulder fixedly connected to the outer surface;

a second housing with a sidewall having an outer surface and a shoulder fixedly connected to the outer surface, the first housing and the second housing being arranged next to each other sidewall to sidewall with the outer surface of the sidewall of each of the first and second housings being in mutually facing relation to one another and the first housing and the second housing being connected to each other;

connecting elements provided in respective front and rear housing zones of the first and second housings between the mutually facing outer sides of the sidewalls; and a seal configured to be elastically compressed between the mutually facing outer sides of the sidewalls of the first and second housings when the connecting elements are interconnected to one another in an installed condition of the household appliance, the respective shoulders of the first and second housings being located in the front housing zone of each respective housing, and the shoulders of the first and second housings being positioned generally facing away from each other in the installed condition of the household appliance and being generally aligned with each other in a direction perpendicular with respect to the outer surfaces of the first and second housings, wherein the shoulders are generally aligned with the connecting elements of the front housing zones of the first and second housings so that an outside force applied by a tool to squeeze the shoulders together operates to interconnect the connecting elements relative to one another, such that the first and second housings are connected solely by virtue of the connecting elements when the outside force is removed from the shoulders.

2. The household appliance as claimed in claim 1, wherein at least one additional shoulder is rigidly joined to each outer surface in the rear housing zone of each housing, which additional shoulders serve as the rear connecting elements.

3. The household appliance as claimed in claim 1, wherein rotating hinge-like connecting members are provided in the rear housing zone of each housing as the rear connecting elements, which members are arranged on the sidewalls spaced apart from each other.

4. The household appliance as claimed in claim 3, wherein the hinge-like connecting members are spaced and arranged so that the seal is elastically compressed when the first and second housings are pivoted to achieve the installed condition.

5. The household appliance as claimed in claim 1, wherein the spacing between the two shoulders is smaller than the aggregate wall thickness of the sidewalls.

6. The household appliance as claimed in claim 1, wherein the spacing between the two shoulders is greater than the thickness of the compressed seal.

7. The household appliance as claimed in claim 1, wherein the shoulders are in each case formed on an ancillary part that is mounted on a carcass of the first or second housing.

8. The household appliance as claimed in claim 7, wherein each ancillary part is mounted on an upper side of the carcass.

9. The household appliance as claimed in claim 7, wherein each ancillary part is an angle part, a first limb of which is fixed to one of the housings and a second limb protrudes from the housing in order to form the shoulder.

10. The household appliance as claimed in claim 7, wherein each ancillary part is plate-shaped and is mounted so as to project over an edge of the carcass, and the shoulder is formed by an edge of a projecting zone of each ancillary part.

11. The household appliance as claimed in claim 10, wherein each ancillary part bears a fixing strap for fixing to a furniture recess surrounding the household appliance.

12. The household appliance as claimed in claim 11, wherein the fixing strap is connected to the ancillary part in a single piece via at least one flexible weak point.

13. The household appliance as claimed in claim 1, wherein a channel that is essentially parallel to the outer side of the adjacent sidewall is formed in each case on the mutually facing sidewalls and the housings are held together by a locking bar inserted into the channels.

14. The household appliance as claimed in claim 13, wherein each channel is delimited by bands separated from each other by slits, the bands of one of the channels engaging in the slits of the other channel.

15. The household appliance as claimed in claim 1, wherein a hinge connecting the housings in a swiveling manner is attached to a border of the mutually facing sidewalls of the housings in each case and the connecting element is attached to the housings and spaced away from the border that blocks the freedom of movement of the hinge.

16. The household appliance as claimed in claim 15, wherein the connecting element comprises the channels and the locking bar.

17. The household appliance as claimed in claim 15, wherein the hinge comprises the channels and the locking bar.

18. The household appliance as claimed in claim 15, wherein the hinge is attached to the rear border of the mutually facing sidewalls.

19. The household appliance as claimed in claim 15, wherein a cavity is formed at one corner of each housing at which the mutually facing sidewalls and a rear wall of each housing meet each other, and the axis of the hinge runs in the cavity.

20. The household appliance as claimed in claim 15, wherein the hinge comprises a part fixed to the first or second housing in each case, and the parts are fixed so as to extend beyond a corner of the first or second housing in each case.

21. The household appliance as claimed in claim 15, wherein the hinge has a removable rotating pin.

22. The household appliance as claimed in claim 15, wherein the connecting element comprises two brackets, which are attached to one of the mutually facing sidewalls in each case and together delimit a latching channel, and a locking bar engaging in the latching channel.

23. The household appliance as claimed in claim 1, wherein a gap between the mutually facing sidewalls is concealed by a covering strip at least at the front of the appliance.

24. The household appliance as claimed in claim 1, wherein the shoulders are essentially identical to one another.

25. The household appliance as claimed in claim 1, further comprising a hinge including a portion that is attached to respective front or rear exterior surfaces of the first and second housings that are perpendicular to the mutually facing sidewalls of the first and second housings.

* * * * *